US008049681B2

(12) United States Patent
Yang et al.

(10) Patent No.: US 8,049,681 B2
(45) Date of Patent: Nov. 1, 2011

(54) WAVEFORM GENERATOR AND PLASMA DISPLAY DEVICE USING THE SAME

(75) Inventors: Hak-Cheol Yang, Suwon-si (KR); Joon-Yeon Kim, Suwon-si (KR); Yon-Goo Park, Suwon-si (KR); Jong-Ki Choi, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 613 days.

(21) Appl. No.: 12/248,819

(22) Filed: Oct. 9, 2008

(65) Prior Publication Data

US 2009/0121748 A1 May 14, 2009

(30) Foreign Application Priority Data

Nov. 8, 2007 (KR) ..... 10-2007-0113809

(51) Int. Cl.
*G09G 3/28* (2006.01)

(52) U.S. Cl. ..... 345/60; 345/68

(58) Field of Classification Search ..... 345/60, 345/68

See application file for complete search history.

(56) References Cited

U.S. PATENT DOCUMENTS 5,909,364 A * 6/1999 Rivet et al. ..... 363/89
6,628,087 B2 * 9/2003 Roh et al. ..... 315/169.3
2005/0200566 A1 * 9/2005 Kim et al. ..... 345/60
2007/0063926 A1 3/2007 Jung et al.
2009/0153535 A1 * 6/2009 Kaminaka et al. ..... 345/208

FOREIGN PATENT DOCUMENTS

EP 1764768 A1 3/2007
KR 10-2003-0060680 A 7/2003
KR 10-2005-0036611 A 4/2005
KR 10-2006-0021235 3/2006
KR 10-2007-0087717 A 8/2007
KR 10-2007-0105741 A 10/2007

OTHER PUBLICATIONS

KIPO Office Action dated Feb. 9, 2009, for priority Korean Patent Application No. 10-2007-0113809.
SIPO Office action dated Jun. 21, 2010, for corresponding Chinese Patent application 200810169616.6.
European Search Report dated Sep. 16, 2010 of the corresponding European Patent Application No. 08166972.3, noting listed references in this IDS.

* cited by examiner

*Primary Examiner* — Richard Hjerpe
*Assistant Examiner* — Sahlu Okebato
(74) *Attorney, Agent, or Firm* — Christie, Parker & Hale, LLP

(57) ABSTRACT

A waveform generator capable of generating a square wave and a ramp wave using one switching element is provided. A waveform generator includes a first transistor having a drain electrode, a gate electrode, and a source electrode. A first resistor and a first diode are coupled at a common node between a first input terminal and the gate electrode. A second resistor is coupled between the gate electrode and a second input terminal. A first capacitor is coupled between the drain electrode and the common node between the first resistor and the first diode.

16 Claims, 14 Drawing Sheets

WAVEFORM GENERATOR AND PLASMA DISPLAY DEVICE USING THE SAME

CROSS-REFERENCE TO RELATED APPLICATION

This application claims priority to and the benefit of Korean Patent Application No. 10-2007-0113809, filed on Nov. 8, 2007, in the Korean Intellectual Property Office, the entire content of which is incorporated herein by reference.

BACKGROUND OF THE INVENTION

1. Field of the Invention

The present invention relates to a waveform generator and a plasma display panel using the same.

2. Description of the Related Art

A plasma display panel (PDP) displays an image by emitting light from a phosphor using ultraviolet (UV) rays of 147 nm generated during the discharge of an inert gas mixture. The PDP can be easily made thin and large and provides an image with remarkably improved picture quality with recent technological developments.

In a PDP, in order to realize gray levels of an image, one frame is divided into a plurality of subfields, each having a different number of emissions to be driven. Each subfield is divided into a reset period for initializing an entire screen, an address period for selecting cells to be turned on, and a sustain period for realizing gray levels in accordance with the number of times of discharge.

In the PDP, in order to display an image, various shapes of driving waveforms are supplied to electrodes. For example, the plasma display device supplies a ramp wave and a square wave to scan electrodes to display an image.

Therefore, the scan driver of the plasma display device includes a switching element for generating the ramp wave and a switching element for generating the square wave, which increases manufacturing costs.

SUMMARY OF THE INVENTION

According to exemplary embodiments of the present invention, a waveform generator is provided that is capable of generating a square wave and a ramp wave using one switching element and a PDP is provided using the same.

In an exemplary embodiment of the present invention, a waveform generator includes a first transistor having a drain electrode, a gate electrode, and a source electrode. A first resistor and a first diode are coupled at a common node between a first input terminal and the gate electrode. A second resistor is coupled between the gate electrode and a second input terminal. A first capacitor is coupled between the drain electrode and the common node between the first resistor and the first diode.

In one exemplary embodiment, the first resistor is a variable resistor.

In one exemplary embodiment, the drain electrode of the first transistor is coupled to a sustain power source and a source electrode of the first transistor is coupled to an output terminal such that a rising ramp waveform is supplied when a high voltage is applied to the first input terminal.

In one exemplary embodiment, the drain electrode of the first transistor is coupled to an output terminal and the source electrode of the first transistor is coupled to a base power source such that a falling ramp waveform is supplied when a high voltage is applied to the first input terminal.

In one exemplary embodiment, the first diode is coupled to allow a current to flow from the first resistor to the gate electrode of the first transistor.

In one exemplary embodiment, the waveform generator further includes a third diode coupled between the gate electrode of the first transistor and the first input terminal to allow a current to flow from the gate electrode of the first transistor to the first input terminal.

In one exemplary embodiment, the waveform generator further includes a second diode coupled between the second resistor and the gate electrode of the first transistor to allow a current to flow from the second resistor to the gate electrode of the first transistor.

In one exemplary embodiment, the waveform generator further includes a voltage stabilizer coupled between the first capacitor and the drain electrode of the first transistor.

In one exemplary embodiment, the voltage stabilizer includes a fourth diode coupled to allow a current to flow from the first capacitor to the drain electrode of the first transistor; and a third resistor coupled with the fourth diode in parallel.

In an exemplary embodiment of the present invention, a plasma display device is provided including discharge cells at crossing regions of scan electrodes, sustain electrodes, and address electrodes; and a scan driver. The scan driver includes a selection circuit for selectively supplying voltages between a first node and a second node to the scan electrodes; a capacitor coupled between the first node and the second node; a first waveform generator coupled to a base power source for supplying a base power source voltage, the first waveform generator being configured to alternatively supply to the second node a rapidly falling waveform that falls rapidly to the base power source voltage and a falling ramp waveform that falls with a slope to the base power source voltage; a second waveform generator coupled to a sustain power source for supplying a sustain power source voltage, the second waveform generator being configured to supply to the first node a rapidly increasing waveform that increases rapidly to the sustain power source voltage and a rising ramp waveform that rises with a slope to the sustain power source voltage; an energy recovery circuit for supplying sustain pulses to the scan electrodes; and a scan pulse supplier coupled between the first node and a scan power source. Each of the first waveform generator and the second waveform generator includes a first transistor having a drain electrode, a gate electrode, and a source electrode; a first resistor and a first diode coupled at a common node between a first input terminal and the gate electrode; a second resistor coupled between the gate electrode and a second input terminal; and a first capacitor coupled between the drain electrode and the common node between the first resistor and the first diode.

In one exemplary embodiment, the first resistor is a variable resistor.

In one exemplary embodiment, the drain electrode of the first transistor of the first waveform generator is coupled with the second node and the source electrode of the first transistor of the first waveform generator is coupled with the base power source.

In one exemplary embodiment, the drain electrode of the first transistor of the second waveform generator is coupled with the sustain power source and the source electrode of the first transistor of the second waveform generator is coupled with the first node.

In one exemplary embodiment, the first diode is coupled to allow a current to flow from the first resistor to the gate electrode.

In one exemplary embodiment, the plasma display device further includes a third diode coupled between the gate electrode and the first input terminal to allow a current to flow from the gate electrode to the first input terminal.

In one exemplary embodiment, the plasma display device further includes a second diode coupled between the second resistor and the gate electrode to allow a current to flow from the second resistor to the gate electrode.

In one exemplary embodiment, the plasma display device further includes a voltage stabilizer coupled between the first capacitor and the drain electrode.

In one exemplary embodiment, the voltage stabilizer includes a fourth diode coupled to allow a current to flow from the first capacitor to the drain electrode; and a third resistor coupled with the fourth diode in parallel.

In one exemplary embodiment, the energy recovery circuit includes a source capacitor for charging a voltage recovered from the scan electrodes; an inductor coupled between the source capacitor and the scan electrodes; a second transistor coupled between the inductor and the second node and configured to turn on when a voltage is supplied from the scan electrodes to the source capacitor; and a third transistor coupled between the inductor and the first node and configured to turn on when a voltage is supplied from the source capacitor to the scan electrodes.

In one exemplary embodiment, the first waveform generator supplies the base power source voltage to the scan electrodes after the second transistor is turned on. In addition, the second waveform generator supplies the sustain power source voltage to the scan electrodes after the third transistor is turned on.

In one exemplary embodiment, the plasma display device further includes an integrated circuit positioned between the first input terminal and the first resistor and between the second input terminal and the second resistor. The integrated circuit includes a first integrated circuit transistor and a second integrated circuit transistor coupled between a first power source and the base power source in an $i^{th}$ channel, where i is a natural number. A common terminal of the first integrated circuit transistor and the second integrated circuit transistor is coupled to the first resistor. The integrated circuit further includes a third integrated circuit transistor and a fourth integrated circuit transistor coupled between the first power source and the base power source in an $(i+1)^{th}$ channel. A common terminal of the third integrated circuit transistor and the fourth integrated circuit transistor is coupled to the second resistor. The integrated circuit further includes an OR gate for performing an OR operation on voltages supplied from the first input terminal and the second input terminal to supply an OR operation result to gate electrodes of the first integrated circuit transistor and the second integrated circuit transistor; a first inverter for inverting the OR operation result and for supplying the inverted OR operation result to the second integrated circuit transistor; and a second inverter for inverting a voltage supplied by the second input terminal and for supplying the inverted voltage to the fourth integrated circuit transistor.

In one exemplary embodiment, the plasma display device further includes an integrated circuit coupled between the first input terminal and the first resistor and between the second input terminal and the second resistor. The integrated circuit includes a first integrated circuit transistor and a second integrated circuit transistor coupled between a first power source and the base power source in an $i^{th}$ channel. A common terminal of the first integrated circuit transistor and the second integrated circuit transistor is coupled to the first resistor. The integrated circuit further includes a third integrated circuit transistor and a first integrated circuit resistor coupled between the first power source and the base power source in an $(i+1)^{th}$ channel. A common terminal of the third integrated circuit transistor and the first integrated circuit resistor is coupled to the second resistor. The integrated circuit further includes a NOR gate for performing a NOR operation on voltages supplied from the first input terminal and the second input terminal to supply a NOR operation result to a gate electrode of the second integrated circuit transistor.

In one exemplary embodiment of the present invention, the plasma display device further includes an integrated circuit coupled between the first input terminal and the first resistor and between the second input terminal and the second resistor. The integrated circuit includes a first integrated circuit transistor and a first integrated circuit resistor coupled between a first power source and the base power source in an $i^{th}$ channel. A common terminal of the first integrated circuit transistor and the first integrated circuit resistor is coupled to the first resistor. The integrated circuit further includes a second integrated circuit transistor and a second integrated circuit resistor coupled between the first power source and the base power source in an $(i+1)^{th}$ channel. A common terminal between the second integrated circuit transistor and the second integrated circuit resistor is coupled with the second resistor.

In one exemplary embodiment, the integrated circuit further includes a third integrated circuit transistor coupled between the gate electrode of the first transistor and the base power source; and a NOR gate coupled to a gate of the third integrated circuit transistor, the first input terminal and the second input terminal being inputs to the NOR gate.

In one exemplary embodiment, the first input terminal is coupled to a gate of the first integrated circuit transistor and the second input terminal is coupled to a gate of the second integrated circuit transistor.

BRIEF DESCRIPTION OF THE DRAWINGS

These and/or other embodiments and features of the invention will become apparent and more readily appreciated from the following description of certain exemplary embodiments, taken in conjunction with the accompanying drawings of which.

DETAILED DESCRIPTION OF EXEMPLARY EMBODIMENTS

Figure 1A:
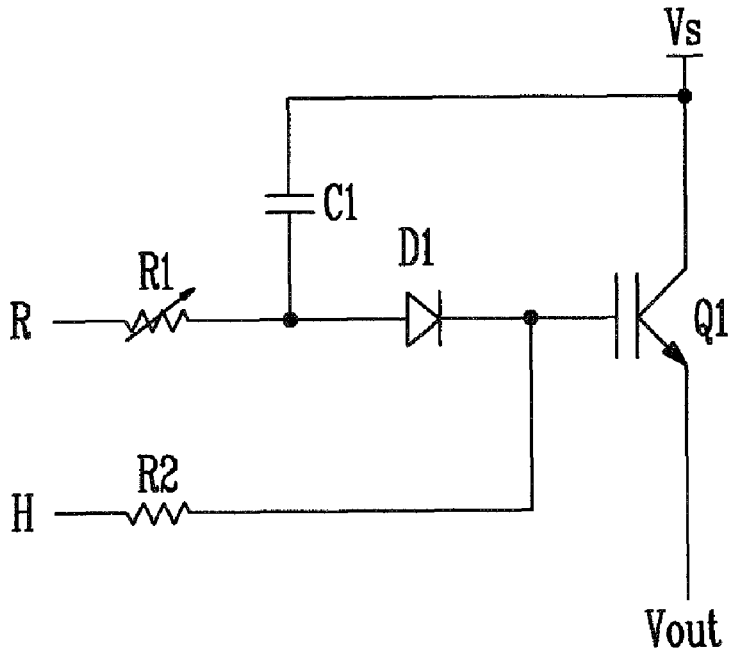
FIGS. 1A and 1B illustrate a waveform generator according to a first exemplary embodiment of the present invention.

Hereinafter, certain exemplary embodiments according to the present invention will be described with reference to the accompanying drawings. Herein, when a first element is described as being coupled to a second element, the first element may be directly coupled to the second element, or alternatively, may be indirectly coupled to the second element via a third element. Further, some of the elements that are not essential to the complete understanding of the invention are omitted for clarity. Also, like reference numerals refer to like elements throughout.

Figure 1B:
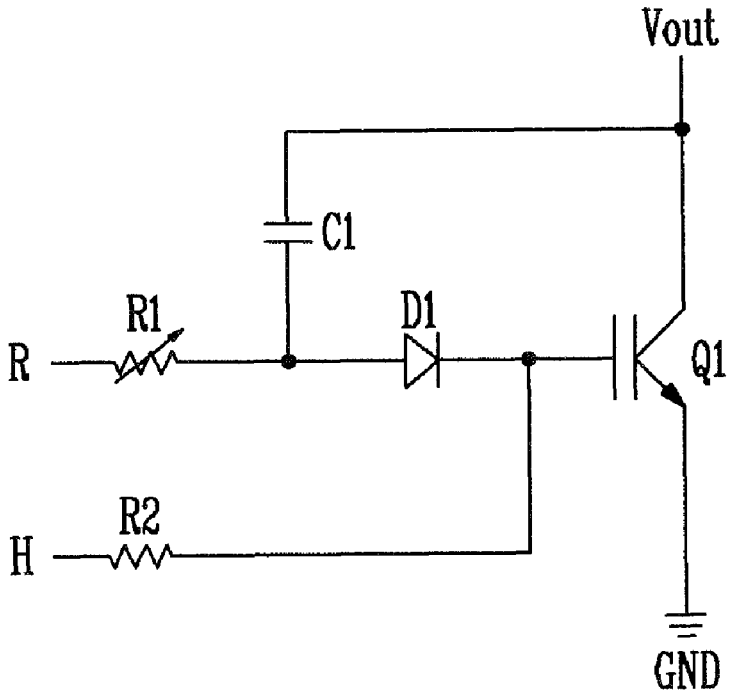

FIGS. 1A and 1B illustrate a waveform generator according to a first exemplary embodiment of the present invention. Referring to FIGS. 1A and 1B, the waveform generator according to the first exemplary embodiment of the present invention includes a first transistor Q1, a first capacitor C1 coupled between the gate electrode and the drain electrode of the first transistor Q1, a first diode D1 coupled between the first capacitor C1 and the gate electrode of the first transistor Q1, a first resistor R1 coupled between a first input terminal R and the first diode D1, and a second resistor R2 coupled between a second input terminal H and the gate electrode of the first transistor Q1.

The drain electrode of the first transistor Q1 is coupled to a sustain power source Vs or is used as an output terminal Vout and the source electrode of the first transistor Q1 is coupled with a base power source GND or is used as the output terminal Vout. When a rising ramp waveform is supplied, as illustrated in FIG. 1A, the drain electrode of the first transistor Q1 is coupled with the sustain power source Vs and the source electrode of the first transistor Q1 is used as the output terminal Vout. Then, when a falling ramp waveform is supplied, as illustrated in FIG. 1B, the source electrode of the first transistor Q1 is coupled with the base power source GND and the drain electrode of the first transistor Q1 is used as the output terminal Vout.

The first transistor Q1 is one of various transistors such as a bipolar junction transistor (BJT), a field effect transistor (FET), or a metal oxide semiconductor field effect transistor (MOSFET). The first transistor Q1 supplies a ramp wave or a square (hard switching) wave to the output terminal Vout to correspond to the voltage supplied to the gate electrode thereof.

The second input terminal H supplies a voltage (a low voltage or a high voltage) via the second resistor R2 to the gate electrode of the first transistor Q1. Accordingly, the first transistor Q1 supplies a rapidly rising or rapidly falling voltage to the output terminal Vout.

The first input terminal R supplies a voltage (a low voltage or a high voltage) via the first resistor R1 to the gate electrode of the first transistor Q1. Accordingly, the first transistor Q1 supplies a falling ramp wave shaped voltage or rising ramp wave shaped voltage to the output terminal Vout. The first resistor R1 is a variable resistor. The resistance value of the first resistor R1 is controlled such that the slope of the ramp wave can be controlled.

The first diode D1 is coupled between the first resistor R1 and the gate electrode of the first transistor Q1. The first diode D1 prevents the voltage supplied by the second input terminal H via the second resistor R2 from being supplied to the first capacitor C1.

The first capacitor C1 is coupled between the drain electrode of the first transistor Q1 and a node between the first diode D1 and the first resistor R1. The first capacitor C1 slowly discharges a voltage between the drain electrode and the gate electrode of the first transistor Q1 to generate the ramp wave.

Figure 2:
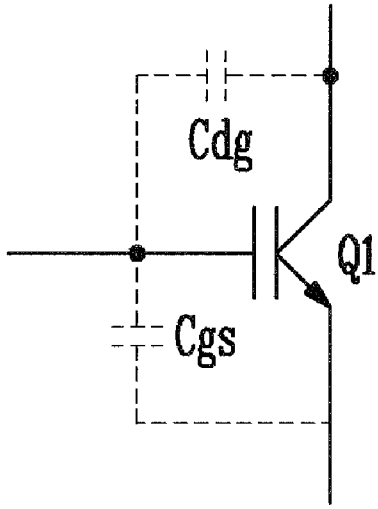
FIG. 2 illustrates the parasitic capacitance of the first capacitor illustrated in FIGS. 1A and 1B.

As illustrated in FIG. 2, a parasitic capacitance Cgs is formed between the gate electrode and the source electrode of the first transistor Q1 and a parasitic capacitance Cdg is formed between the drain electrode and the gate electrode of the first transistor Q1. When the gate voltage of the first transistor Q1 is set as a voltage no less than a threshold voltage Vth, a channel is formed so that current flows between the drain electrode and the source electrode of the first transistor Q1. When the gate voltage is set to be no less than the threshold voltage Vth, the parasitic capacitor Cgs is charged and the parasitic capacitor Cdg is discharged. While the voltage of the parasitic capacitor Cdg is completely discharged, a voltage between the gate electrode and the source electrode of the first transistor Q1 is set as the threshold voltage Vth.

While the voltage between the gate electrode and the source electrode of the first transistor Q1 is set as the threshold voltage Vth, the slope of an output waveform is determined. In a common driving method, since the magnitude of the parasitic capacitor Cdg is negligible, the first transistor Q1 performs a rapidly falling or rising hard switching operation. According to the present invention, the first capacitor C1 is added to increase the capacity of a capacitor between the gate electrode and the drain electrode of the first transistor Q1 so that the ramp wave is generated. The slope of the ramp wave is determined by the resistance of the gate electrode of the first transistor Q1 and the capacity of the first capacitor C1. That is, according to an exemplary embodiment of the present invention, the resistance value of the first resistor R1 that is a variable resistor is controlled so that the slope of the ramp wave can be determined.

Operation processes will now be described. First, when a high voltage is supplied to the first input terminal R, the ramp wave is output from the first transistor Q1 due to the first resistor R1 and the first capacitor C1. When coupling is made as illustrated in FIG. 1A, a ramp pulse falling from the sustain power source Vs with a slope is applied to the output terminal Vout. When coupling is made as illustrated in FIG. 1B, a ramp pulse falling from an arbitrary voltage of the output terminal Vout to the voltage of the base power source GND is applied to the output terminal Vout.

When a high voltage is supplied to the second input terminal H, the first transistor Q1 is turned on. Accordingly, when the coupling is made as illustrated in FIG. 1A, the sustain power source Vs is supplied to the output terminal Vout and, when the coupling is made as illustrated in FIG. 1B, the voltage of the base power source GND is supplied to the output terminal Vout.

Figure 3:
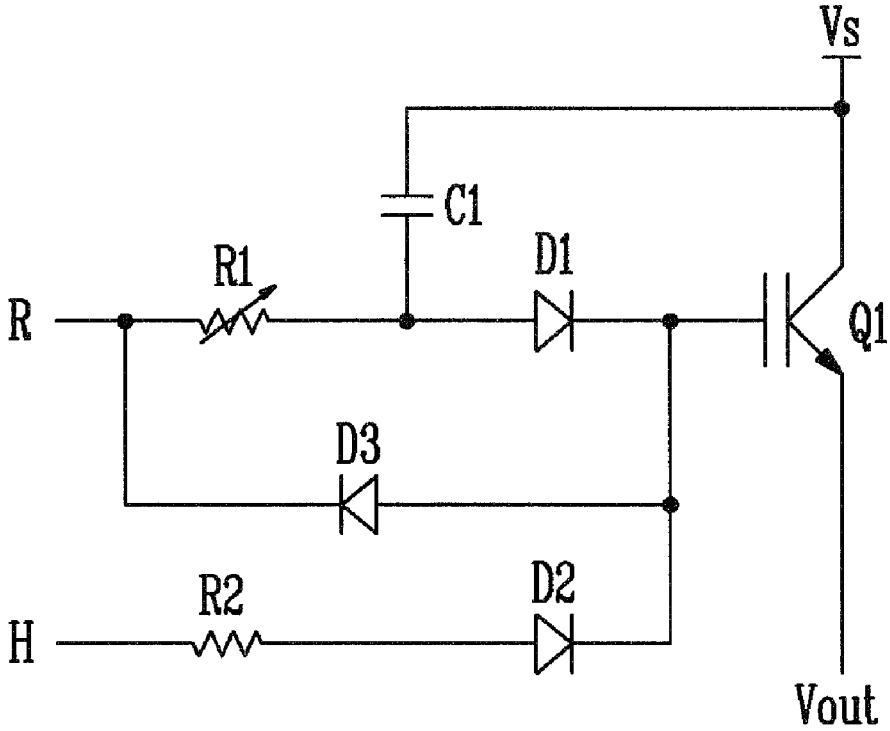
FIG. 3 illustrates a waveform generator according to a second exemplary embodiment.

On the other hand, as illustrated in FIG. 3, the waveform generator according to an exemplary embodiment of the present invention can additionally include a second diode D2 positioned between the second resistor R2 and the gate electrode of the first transistor Q1 and a third diode D3 coupled between the gate electrode of the first transistor Q1 and the first input terminal R.

The second diode D2 prevents unnecessary current from being supplied by the gate electrode of the first transistor Q1 to the second resistor R2. The third diode D3 is formed so that a current can flow from the gate electrode of the first transistor Q1 to the first input terminal R. The third diode D3 provides a path through which the voltage of the gate electrode of the first transistor Q1 can rapidly fall.

Figure 4A:
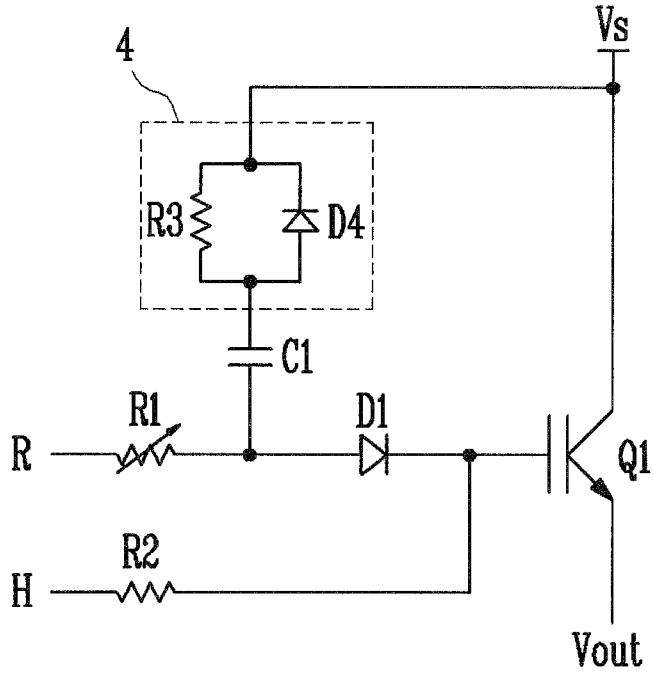
FIGS. 4A and 4B illustrate a waveform generator according to a third exemplary embodiment of the present invention.
Figure 4B:
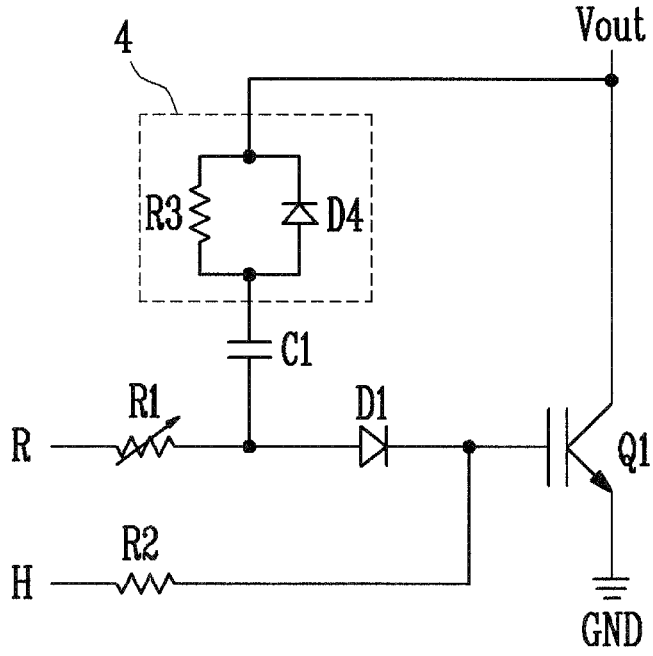

FIGS. 4A and 4B illustrate a waveform generator according to a third exemplary embodiment of the present invention. In FIGS. 4A and 4B, the same parts as the parts of FIGS. 1A and 1B are denoted by the same reference numerals and detailed description thereof will be omitted.

Referring to FIGS. 4A and 4B, the waveform generator according to the third exemplary embodiment of the present invention additionally includes a voltage stabilizer 4 between the first capacitor C1 and the drain electrode of the first transistor Q1. The voltage stabilizer 4 prevents a change in the voltage of the drain electrode of the first transistor Q1 from affecting the voltage of the gate electrode of the first transistor Q1.

Therefore, the voltage stabilizer 4 includes a fourth diode D4 positioned between the first capacitor C1 and the drain electrode of the first transistor Q1 and a third resistor R3 coupled with the fourth diode D4 in parallel.

The fourth diode D4 is positioned such that current can flow from the first capacitor C1 to the drain electrode of the first transistor Q1. The third resistor R3 runs parallel with the fourth diode D4. The third resistor R3 prevents the change in the voltage of the drain electrode of the first transistor Q1 from affecting the voltage of the gate electrode of the first transistor Q1.

Figure 5:
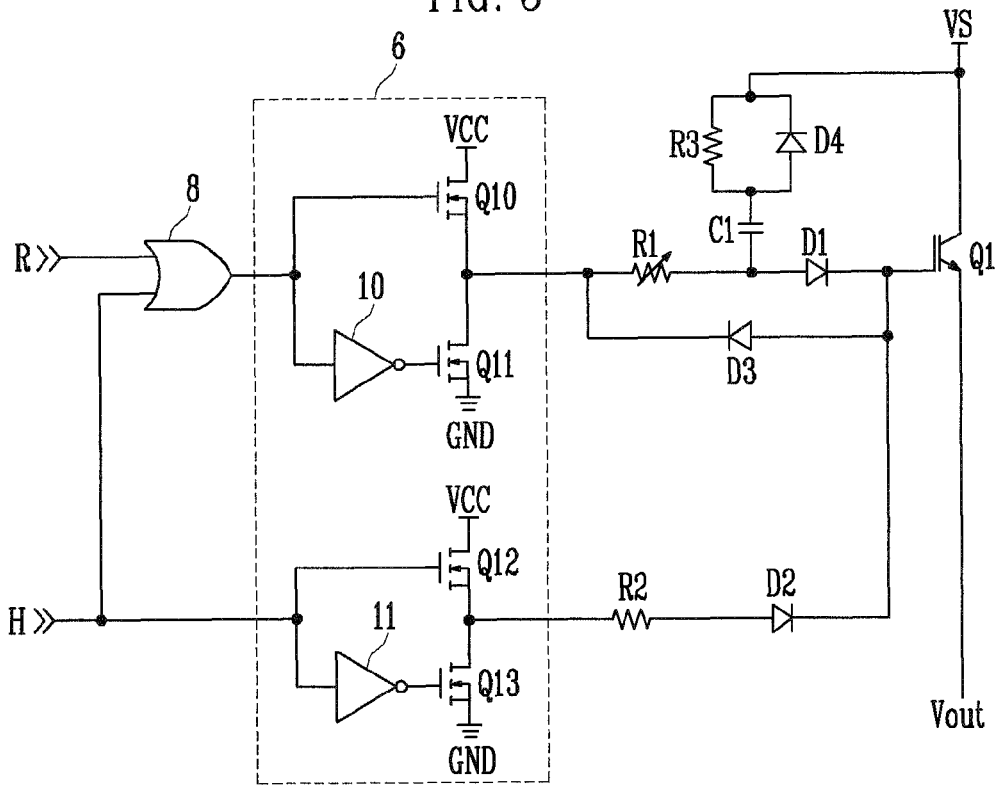
FIG. 5 illustrates an example of supplying a power source to the waveform generator using a conventional gate integrated circuit.

FIG. 5 illustrates an example of supplying a power source to the waveform generator using a conventional gate integrated circuit 6. In FIG. 5, for convenience, it is assumed that the drain electrode of the first transistor Q1 is coupled with the sustain power source Vs.

Referring to FIG. 5, a gate integrated circuit 6 includes transistors Q10 and Q11 and transistors Q12 and Q13 provided in channels, respectively, and inverters 10 and 11 coupled with the $11^{th}$ transistor Q11 and the $13^{th}$ transistor Q13, respectively. The transistors Q10 and Q11 and the transistors Q12 and Q13 provided in the channels, respectively, are serially provided between a first power source VCC and the base power source GND. The $10^{th}$ transistor Q10 and the $12^{th}$ transistor Q12 are coupled with the first power source VCC and the $11^{th}$ transistor Q11 and the $13^{th}$ transistor Q13 are coupled with the base power source GND.

The common terminal of the $10^{th}$ transistor Q10 and the $11^{th}$ transistor Q11 is coupled with the first resistor R1. The common terminal of the $12^{th}$ transistor Q12 and the $13^{th}$ transistor Q13 is coupled with the second resistor R2.

The first input terminal R is coupled with the input terminal of an OR gate 8. The second input terminal H is coupled with the input terminal of the OR gate 8, a second inverter 11, and the gate electrode of the $12^{th}$ transistor Q12. The output terminal of the OR gate 8 is coupled with a first inverter 10 and the gate electrode of the $10^{th}$ transistor Q10.

TABLE 1

| | | | | |
|---|---|---|---|---|
| R | 0 | 0 | 1 | 1 |
| H | 0 | 1 | 0 | 1 |
| Q1 | OFF | H/S | Ramp | H/S |

In Table 1 above, 0 represents a low voltage, 1 represents a high voltage, and H/S represents a hard switching state.

Operation processes will now be described with reference to Table 1 and FIG. 5. First, 0 is input to the first input terminal R and the second input terminal H. When 0 is input to the first input terminal R and the second input terminal H, 0 is output from the OR gate 8. Therefore, the $11^{th}$ transistor Q11 coupled with the OR gate 8 is turned on and the base power source GND is supplied to the first resistor R1. When 0 is supplied to the second input terminal H, the $13^{th}$ transistor Q13 is turned on so that the base power source GND is supplied to the second resistor R2. In this case, a voltage applied to the gate electrode of the first transistor Q1 in a previous period is rapidly reduced to the base power source GND via the third diode D3 so that the first transistor Q1 is turned off.

When 0 is input to the first input terminal R and 1 is input to the second input terminal H, 1 is output from the OR gate 8. When 1 is output from the OR gate 8, the $10^{th}$ transistor Q10 is turned on. Therefore, the voltage of the first power source VCC is supplied to the first resistor R1. When 1 is supplied to the second input terminal H, the $12^{th}$ transistor Q12 is turned on so that the voltage of the first power source VCC is supplied to the second resistor R2. In this case, the first transistor Q1 is hard switched by the voltage supplied by the second resistor R2. Therefore, the sustain power source Vs is output to the output terminal Vout.

When 1 is input to the first input terminal R and 1 is input to the second input terminal H, 1 is output from the OR gate 8. When 1 is output from the OR gate 8, the $10^{th}$ transistor Q10 is turned on so that the voltage of the first power source VCC is supplied to the first resistor R1. When 1 is input to the second input terminal H, the $12^{th}$ transistor Q12 is turned on so that the voltage of the first power source VCC is supplied to the second resistor R2. In this case, the first transistor Q1 is hard switched by the voltage supplied by the second resistor R2. Therefore, the sustain power source Vs is output to the output terminal Vout.

When 1 is input to the first input terminal R and 0 is input to the second input terminal H, 1 is output from the OR gate 8. When 1 is output from the OR gate 8, the $10^{th}$ transistor Q10 is turned on so that the voltage of the first power source VCC is supplied to the first resistor R1. When 0 is supplied to the second input terminal H, the $13^{th}$ transistor Q13 is turned on so that the voltage of the base power source GND is supplied to the second resistor R2. In this case, the first transistor Q1 supplies a ramp waveform that falls with a predetermined slope from the sustain power source Vs to correspond to the voltage applied to the first resistor R1 to the output terminal Vout.

As described above, the waveform generator according to an exemplary embodiment of the present invention is coupled with the conventional gate integrated circuit 6 to be stably driven. On the other hand, according to additional exemplary embodiments of the present invention, the structure of the gate integrated circuit is partially changed to drive the waveform generator.

Figure 6:
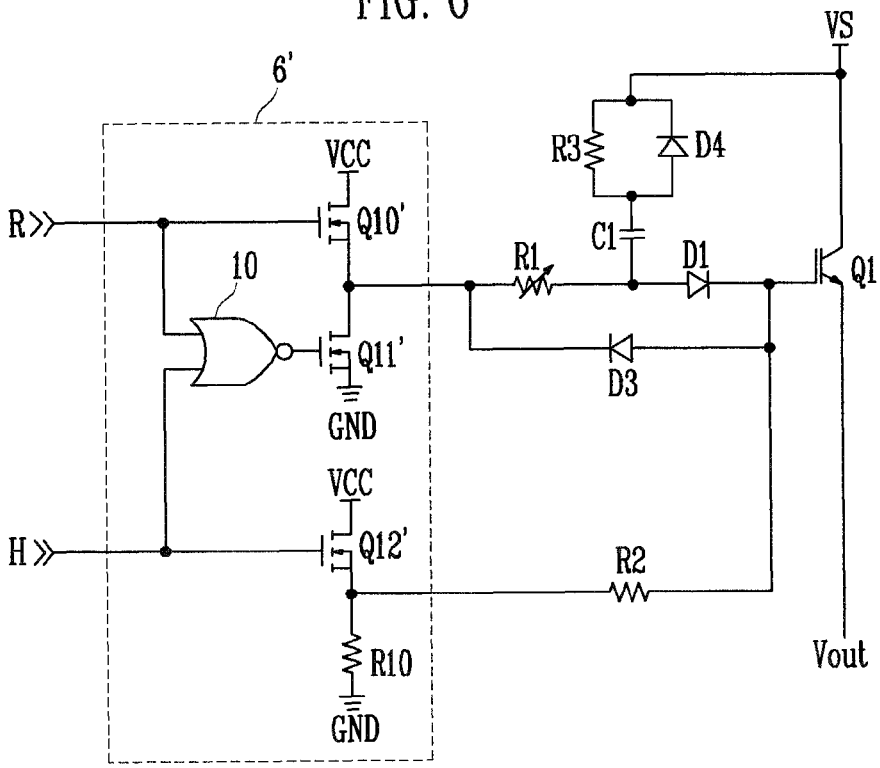
FIG. 6 illustrates a first exemplary embodiment in which a gate integrated circuit is changed to supply a power source to the waveform generator.

FIG. 6 illustrates a first exemplary embodiment in which a gate integrated circuit is changed to supply a power source to the waveform generator.

Referring to FIG. 6, a gate integrated circuit 6' includes a $10^{th}$ transistor Q10' and an $11^{th}$ transistor Q11' positioned between the first power source VCC and the base power source GND in a $j^{th}$ (j is an odd or even number) channel and a $12^{th}$ transistor Q12' and a $10^{th}$ resistor R10 positioned between the first power source VCC and the base power source GND in a $(j+1)^{th}$ channel. The resistance value of the $10^{th}$ resistor R10 is larger than the resistance values of the first resistor R1 and the second resistor R2.

The common terminal of the $10^{th}$ transistor Q10' and the $11^{th}$ transistor Q11' is coupled with the first resistor R1. The common terminal of the $12^{th}$ transistor Q12' and the $10^{th}$ resistor R10 is coupled with the second resistor R2.

The gate electrode of the $10^{th}$ transistor Q10' is coupled with the first input terminal R and the gate electrode of the $12^{th}$ transistor Q12' is coupled with the second input terminal H. The gate electrode of the $11^{th}$ transistor Q11' is coupled with the output terminal of a NOR gate 10. The NOR gate 10 performs a NOR operation on voltages supplied by the first input terminal R and the second input terminal H.

Operation processes will now be described with reference to Table 1 and FIG. 6. When 0 is input by the first input terminal R and the second input terminal H, 1 is output from the NOR gate 10. When 1 is output from the NOR gate 10, the $11^{th}$ transistor Q11' is turned on so that the base power source GND is supplied to the gate electrode of the first transistor Q1.

When 0 is input to the first input terminal R and the second input terminal H, the $10^{th}$ transistor Q10' and the $12^{th}$ transistor Q12' are turned off. Therefore, a voltage applied to the gate electrode of the first transistor Q1 in a previous period rapidly falls via the $11^{th}$ transistor Q11' so that the first transistor Q1 is turned off.

When 0 is input to the first input terminal R and 1 is input to the second input terminal H, 0 is output from the NOR gate 10. When 0 is output from the NOR gate 10, the $11^{th}$ transistor Q11' is turned off. When 0 is input to the first input terminal R, the $10^{th}$ transistor Q10' coupled with the first input terminal R is turned off. When 1 is input to the second input terminal H, the $12^{th}$ transistor Q12' is turned on so that the voltage of the first power source VCC is supplied to the second resistor R2. In this case, the first transistor Q1 is hard switched by a voltage supplied by the second resistor R2. Therefore, the sustain power source Vs is output to the output terminal Vout.

When 1 is input to the first input terminal R and 1 is input to the second input terminal H, 0 is output from the NOR gate 10. When 0 is output from the NOR gate 10, the $11^{th}$ transistor Q11' is turned off. When 1 is input to the first input terminal R, the $10^{th}$ transistor Q10' is turned on so that the voltage of the first power source VCC is supplied to the first resistor R1. When 1 is input to the second input terminal H, the $12^{th}$ transistor Q12' is turned on so that the voltage of the first power source VCC is supplied to the second resistor R2. In this case, the first transistor Q1 is hard switched by the voltage supplied by the second resistor R2. Therefore, the sustain power source Vs is output to the output terminal Vout.

When 1 is input to the first input terminal R and 0 is input to the second input terminal H, 0 is output from the NOR gate 10. When 0 is output from the NOR gate 10, the $11^{th}$ transistor Q11' is turned off. When 1 is input to the first input terminal R, the $10^{th}$ transistor Q10' is turned on so that the voltage of the first power source VCC is supplied to the first resistor R1. When 0 is input to the second input terminal H, the $12^{th}$ transistor Q12' is turned off. In this case, the first transistor Q1 supplies a ramp waveform that falls with a slope (e.g., a predetermined slope) from the sustain power source Vs to correspond to the voltage applied to the first resistor R1 to the output terminal Vout.

Figure 7:
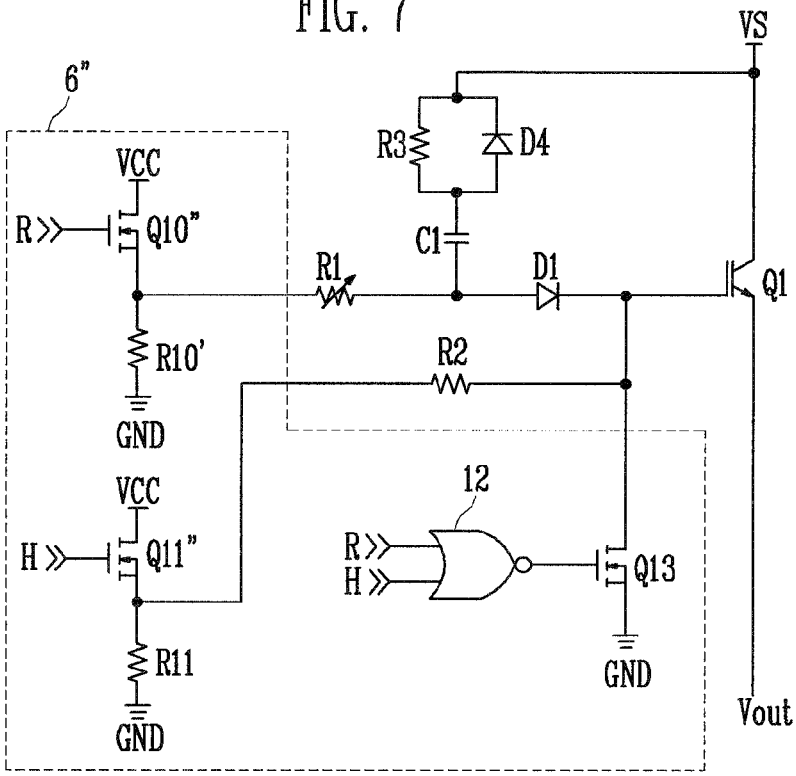
FIG. 7 illustrates a second exemplary embodiment in which the gate integrated circuit is changed to supply the power source to the waveform generator.

FIG. 7 illustrates a second exemplary embodiment in which the gate integrated circuit is changed to supply the power source to the waveform generator. In FIG. 7, a transistor and a resistor are positioned in the channels of a gate integrated circuit 6", respectively.

Referring to FIG. 7, the channels of the gate integrated circuit 6" include a transistor Q10" and a resistor R10' and a transistor Q11" and a resistor R11, respectively. The two channels of the gate integrated circuit 6" include a NOR gate 12 and a $13^{th}$ transistor Q13. The resistance value of the $10^{th}$ resistor R10' is larger than the resistance values of the first resistor R1 and the second resistor R2.

The common terminal of the $10^{th}$ transistor Q10" and the $10^{th}$ resistor R10' is coupled with the first resistor R1. The gate electrode of the $10^{th}$ transistor Q10" positioned in an $i^{th}$ channel is coupled with the first input terminal R.

The common terminal of the $11^{th}$ transistor Q11" and an $11^{th}$ resistor R11 is coupled with the second resistor R2. The gate electrode of the $11^{th}$ transistor Q11" is coupled with the second input terminal H.

The NOR gate 12 positioned in the $i^{th}$ (i is a natural number) channel and an $(i+1)^{th}$ channel performs a NOR operation on the voltages supplied by the first input terminal R and the second input terminal H to output a resultant voltage. The voltage output from the NOR gate 12 is supplied to the gate electrode of the $13^{th}$ transistor Q13. The $13^{th}$ transistor Q13 is positioned between the gate electrode of the first transistor Q1 and the base power source GND.

Operation processes will now be described with reference to Table 1 and FIG. 7. When 0 is input to the first input terminal R and the second input terminal H, 1 is output from the NOR gate 12. When 1 is output from the NOR gate 12, the $13^{th}$ transistor Q13 is turned on so that the base power source GND is supplied to the gate electrode of the first transistor Q1. In this case, the first transistor Q1 is turned off. When 0 is input to the first input terminal R and the second input terminal H, the $10^{th}$ transistor Q10" and the $11^{th}$ transistor Q11" is turned off. Therefore, the first power source VCC is not supplied to the first resistor R1 and the second resistor R2.

When 0 is input to the first input terminal R and 1 is input to the second input terminal H, 0 is output from the NOR gate 12. When 0 is output from the NOR gate 12, the $13^{th}$ transistor Q13 is turned off. When 0 is input to the first input terminal R, the $10^{th}$ transistor Q10" coupled with the first input terminal R is turned off. When 1 is input to the second input terminal H, the $11^{th}$ transistor Q11" coupled with the second input terminal H is turned on. When the $11^{th}$ transistor Q11" is turned on, the voltage of the first power source VCC is supplied to the second resistor R2 so that the first transistor Q1 is hard switched. Therefore, the sustain power source Vs is output to the output terminal Vout.

When 1 is input to the first input terminal R and 1 is input to the second input terminal H, 0 is output from the NOR gate 12. When 0 is output from the NOR gate 12, the $13^{th}$ transistor Q13 is turned off. When 1 is input to the first input terminal R, the $10^{th}$ transistor Q10" coupled with the first input terminal R is turned on. When 1 is input to the second input terminal H, the $11^{th}$ transistor Q11" coupled with the second input terminal H is turned on. When the $11^{th}$ transistor Q11" is turned on, the voltage of the first power source VCC is supplied to the second resistor R2 so that the first transistor Q1 is hard switched. Therefore, the sustain power source Vs is output to the output terminal Vout.

When 1 is input to the first input terminal R and 0 is input to the second input terminal H, 0 is output from the NOR gate 12. When 0 is output from the NOR gate 12, the $13^{th}$ transistor Q13 is turned off. When 0 is input to the second input terminal H, the $11^{th}$ transistor Q11" coupled with the second input terminal H is turned off. When 1 is input to the first input terminal R, the $10^{th}$ transistor Q10" coupled with the first input terminal R is turned on. When the $10^{th}$ transistor Q10" is turned on, the voltage of the first power source VCC is supplied to the first resistor R1. Accordingly, the first transistor Q1 supplies a ramp waveform that falls with a slope (e.g., a predetermined slope) from the sustain power source Vs to correspond to the voltage applied to the first resistor R1 to the output terminal Vout.

Figure 8:
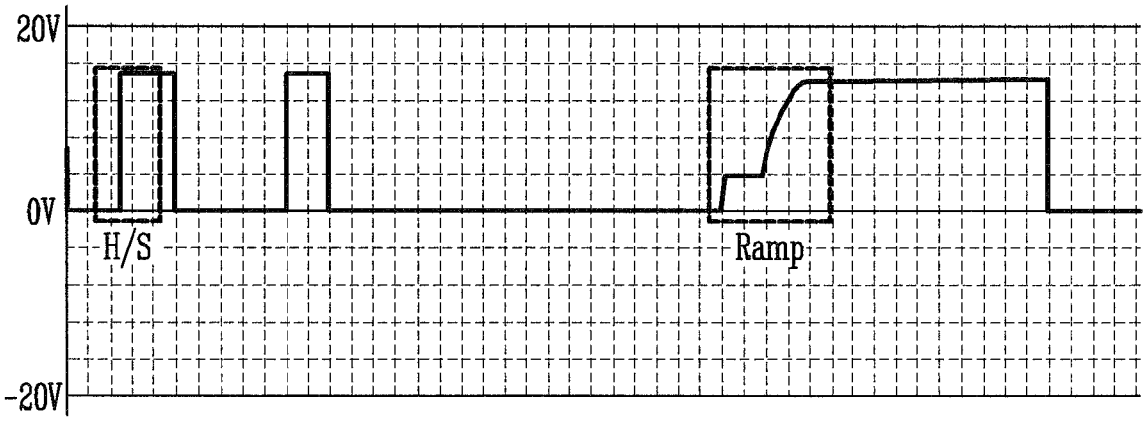
FIG. 8 illustrates the simulation result of a waveform generator according to an exemplary embodiment of the present invention.

FIG. 8 illustrates the simulation result of a waveform generator according to an exemplary embodiment of the present invention. Referring to FIG. 8, the waveform generator outputs a square waveform that rapidly rises and falls when a power source is supplied (hard switched) to the second resistor R2. The waveform generator outputs a ramp waveform when a power source is supplied to the first resistor R1. That is, the waveform generator according to exemplary embodiments of the present invention can stably generate a square wave and a ramp wave using one transistor.

Figure 9:
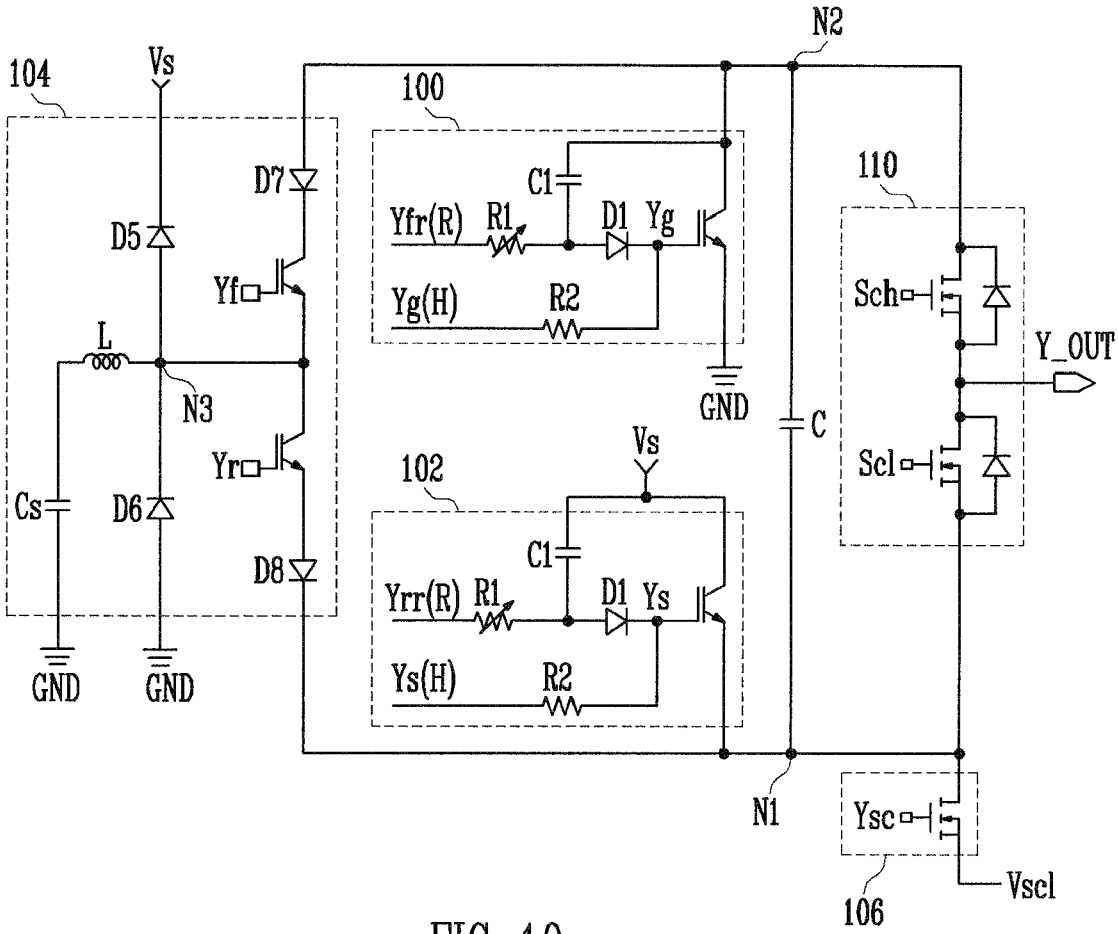
FIG. 9 illustrates an example in which a waveform generator according to an exemplary embodiment of the present invention is applied to a scan driver.

FIG. 9 illustrates an example in which a waveform generator according to an exemplary embodiment of the present invention is applied to a scan driver. In FIG. 9, the scan driver is coupled with scan electrodes to supply driving waveforms to the scan electrodes. That is, Y_OUT illustrated in FIG. 9 is coupled with the scan electrodes. A PDP includes discharge cells formed by sustain electrodes that run parallel with the scan electrodes, and address electrodes that cross and face the scan electrodes.

Referring to FIG. 9, the scan driver of the PDP according to an exemplary embodiment of the present invention includes a selection circuit 110 coupled with the scan electrodes, first and second waveform generators 100 and 102, an energy recovery circuit 104, and a scan pulse supplier 106 for supplying scan pulses.

The selection circuit 110 is provided for each of the scan electrodes. The selection circuit 110 controls the turning on and off of transistors Sch and Scl and selectively supply voltages supplied to a first node N1 (or a first end) and a second node N2 (or a second end) to the scan electrodes. An internal diode is formed in each of the transistor Sch and the transistor Scl. The internal diode of the transistor Sch is formed to supply current from the scan electrodes to the second node N2. The internal diode of the transistor Scl is formed to supply current from the first node N1 to the scan electrodes.

The first waveform generator 100 is used to supply a falling ramp waveform and a voltage reduced to the base power source GND. Therefore, the source electrode of a transistor Yg is coupled with the base power source GND and the drain electrode of the transistor Yg is coupled with the second node N2. Since the detailed structure and operation processes of the first waveform generator 100 were described in detail, description thereof will be omitted.

The second waveform generator 102 is used to supply a rising ramp waveform and a voltage that increases to the sustain power source Vs. Therefore, the source electrode of a transistor Ys is coupled with the first node N1 and the drain electrode of the transistor Ys is coupled with the sustain power source Vs. Since the detailed structure and operation processes of the second waveform generator 102 were described in detail, description thereof will be omitted.

The scan pulse supplier 106 supplies the scan pulses to the scan electrodes in an address period. Therefore, the scan pulse supplier 106 includes a transistor Ysc positioned between a scan power source Vscl and the first node N1.

The energy recovery circuit 104 supplies sustain pulses in a sustain period of each subfield. The energy recovery circuit 104 recovers energy from a panel capacitor equivalently formed by the scan electrodes and the sustain electrodes so that power consumption can be reduced when the sustain pulses are supplied and re-supplies the sustain pulses using recovered energy. The energy recovery circuit 104 includes a transistor Yf, a transistor Yr, diodes D5 to D8, an inductor L, and a source capacitor Cs.

The source capacitor Cs recovers energy from a panel capacitor in the sustain period to charge a voltage and supplies the charged voltage to the panel capacitor. Therefore, the source capacitor Cs has capacity that can charge a voltage corresponding to half of the sustain power source Vs.

The inductor L is positioned between the source capacitor Cs and the scan electrodes. The inductor L forms a resonance circuit with the panel capacitor. Therefore, a voltage supplied from the source capacitor Cs and the panel capacitor increases to about the sustain voltage Vs.

The transistor Yf is positioned between the inductor L and the second node N2. The transistor Yf is turned on when energy is recovered from the panel capacitor to the source capacitor Cs.

After the transistor Yf is turned on so that energy is charged in the source capacitor Cs, the transistor Yg included in the first waveform generator 100 is turned on so that the base power source GND is supplied to the second node N2. In this case, the transistor Yg is turned on by the voltage supplied to the second resistor R2.

The transistor Yr is positioned between the inductor L and the first node N1. The transistor Yr is turned on when the voltage charged in the source capacitor Cs is supplied to the scan electrodes.

After the transistor Yr is turned on so that the voltage is supplied to the scan electrodes, the transistor Ys included in the second waveform generator 102 is turned on so that the sustain power source Vs is supplied to the first node N1. The transistor Ys is turned on by the voltage supplied by the input terminal Ys(H) via the second resistor R2.

That is, the energy recovery circuit 104 supplies the base power source GND and the sustain power source Vs using the transistor Yg included in the first waveform generator 100 and the transistor Ys included in the second waveform generator 102. Therefore, the two transistors can be removed of the energy recovery circuit 104 so that manufacturing cost can be reduced.

A fifth diode D5 is positioned between the sustain power source Vs and a third node N3. The fifth diode D5 is positioned such that current can be supplied from the third node N3 to the sustain power source Vs. The fifth diode D5 prevents the voltage of the third node N3 from increasing to no less than the sustain power source Vs.

A sixth diode D6 is positioned between the base power source GND and the third node N3. The sixth diode D6 is positioned such that current can be supplied from the base power source GND to the third node N3. The sixth diode D6 prevents the voltage of the third node N3 from being reduced to no more than the base power source GND.

A seventh diode D7 is positioned between the second node N2 and the transistor Yf to prevent current from flowing from the third node N3 to the second node N2. An eighth diode D8 is positioned between the transistor Yr and the first node N1 to prevent current from flowing from the first node N1 to the third node N3.

A capacitor C is coupled between the first node N1 and the second node N2. The capacitor C transmits the amount of a change in a voltage between the first node N1 and the second node N2.

Figure 10:
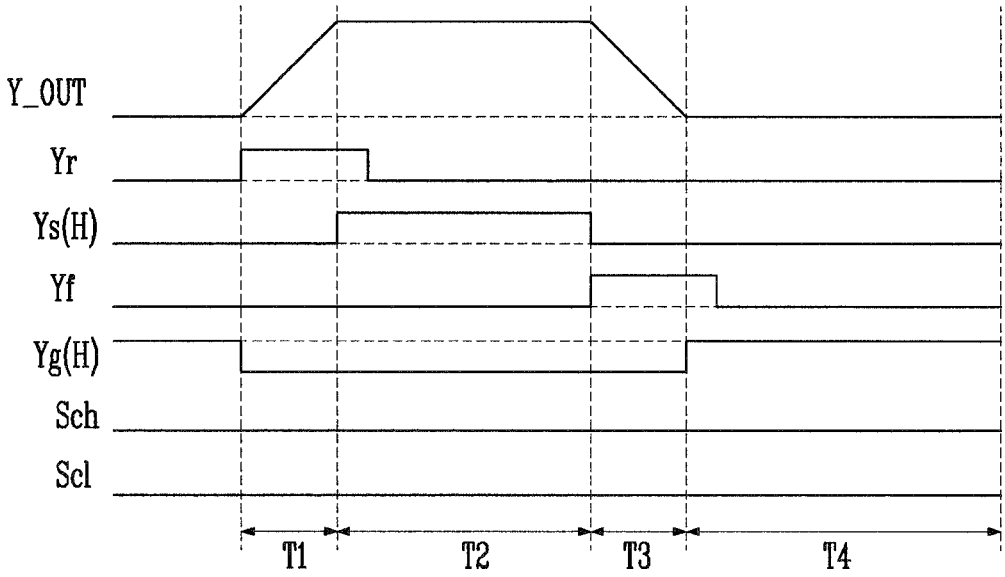
FIG. 10 illustrates sustain pulses supplied to scan electrodes in a sustain period and operation processes of switches.

FIG. 10 illustrates sustain pulses supplied to scan electrodes in a sustain period and operation processes of switches. FIGS. 11A to 11D illustrate current paths corresponding to the operation processes of FIG. 10.

Figure 11A:
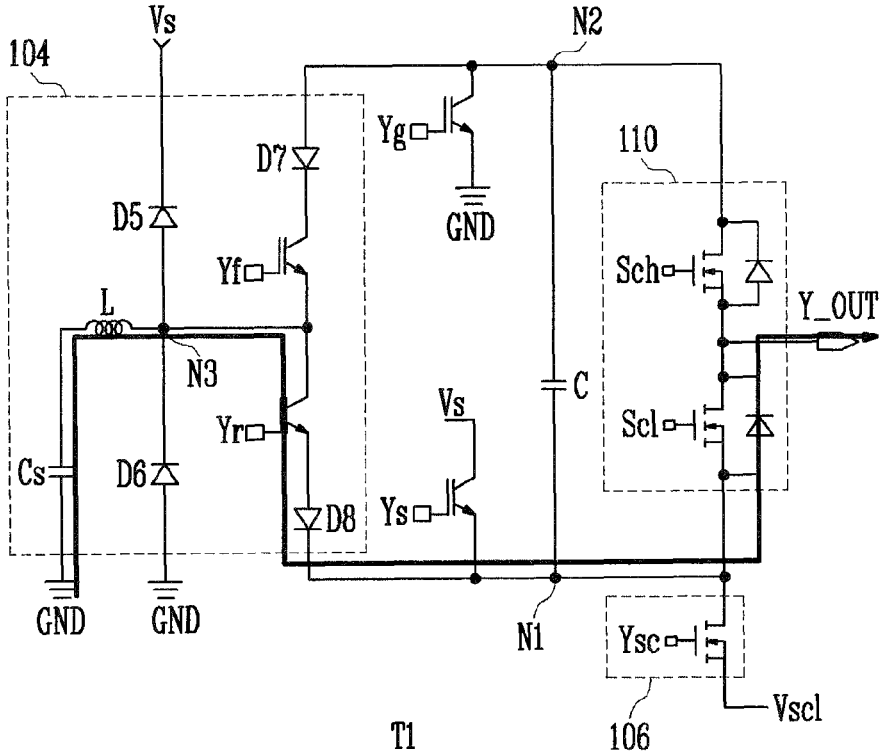
FIGS. 11A to 11D illustrate current paths corresponding to the operation processes of FIG. 10.
Figure 11B:
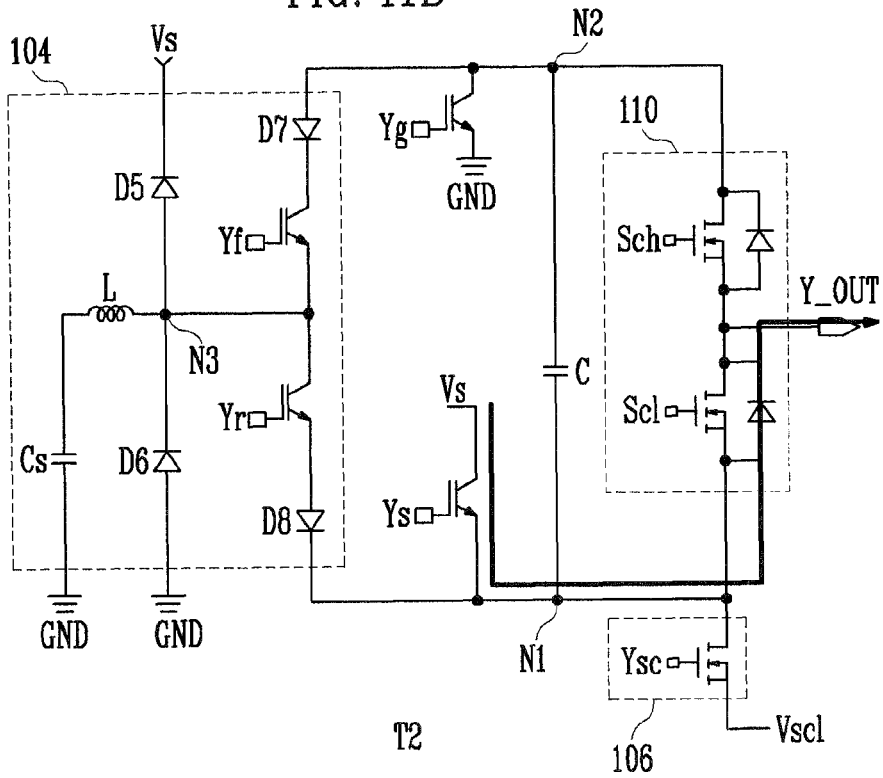
Figure 11C:
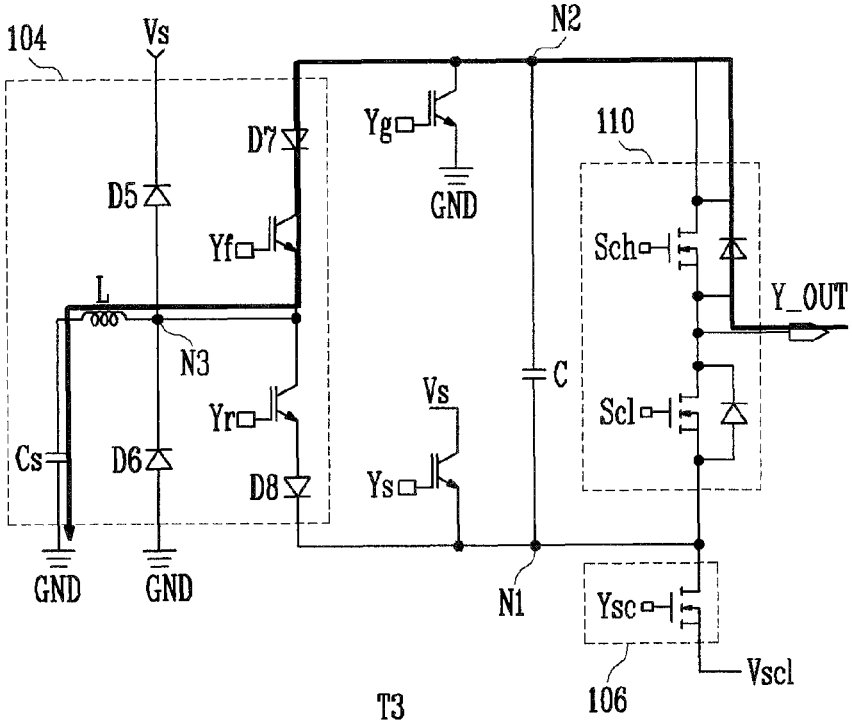
Figure 11D:
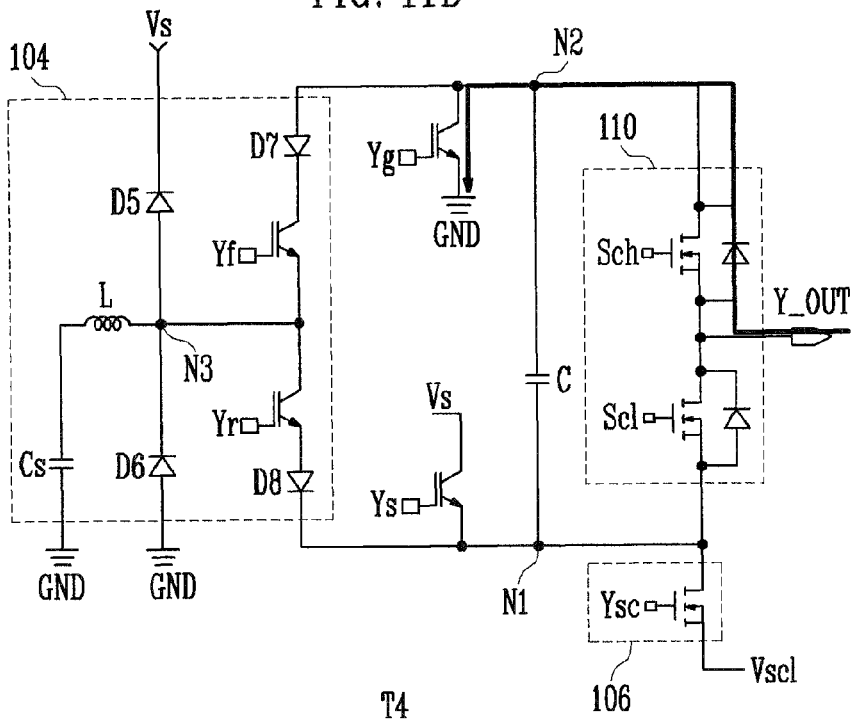

Operation processes will now be described with reference to FIGS. 10 to 11D. First, the transistor Yr is turned on in a first period T1. When the transistor Yr is turned on, as illustrated in FIG. 11A, the voltage charged in the source capacitor Cs is supplied to the scan electrodes via the inductor L, the transistor Yr, the eighth diode D8, and the internal diode of the transistor Scl. Accordingly, the voltage of the scan electrodes increases to about the voltage of the sustain power source Vs.

The transistor Ys is turned on in a second period T2. The transistor Ys is turned on by the voltage applied by the input terminal Ys(H) via the second resistor R2. When the transistor Ys is turned on, as illustrated in FIG. 11B, the sustain power source Vs is supplied to the scan electrodes via the internal diodes of the transistor Ys and the transistor Scl. Then, the sustain power source Vs is supplied to the scan electrodes so that the sustain discharge is stably generated.

The transistor Yf is turned on in a third period T3. When the transistor Yf is turned on, as illustrated in FIG. 11C, the voltage charged in the panel capacitor is supplied to the source capacitor Cs via the internal diode of the transistor Sch, the seventh diode D7, the transistor Yf, and the inductor L. At this time, the source capacitor Cs is charged with a voltage corresponding to about ½ of the sustain power source Vs.

The transistor Yg is turned on in a fourth period T4. The transistor Yg is turned on by the voltage applied by the input terminal Yg(H) via the second resistor R2. When the transistor Yg is turned on, the scan electrodes are coupled with the base power source GND via the internal diode of the transistor Sch and the transistor Yg.

The scan driver according to an exemplary embodiment of the present invention supplies the sustain pulses to the scan electrodes in the sustain period of each of the sustain pulses through the above-described processes. According to an exemplary embodiment of the present invention, since the base power source GND and the sustain power source Vs are supplied using the transistor Yg and the transistor Ys that supply ramp pulses, manufacturing costs can be reduced.

Figure 12:
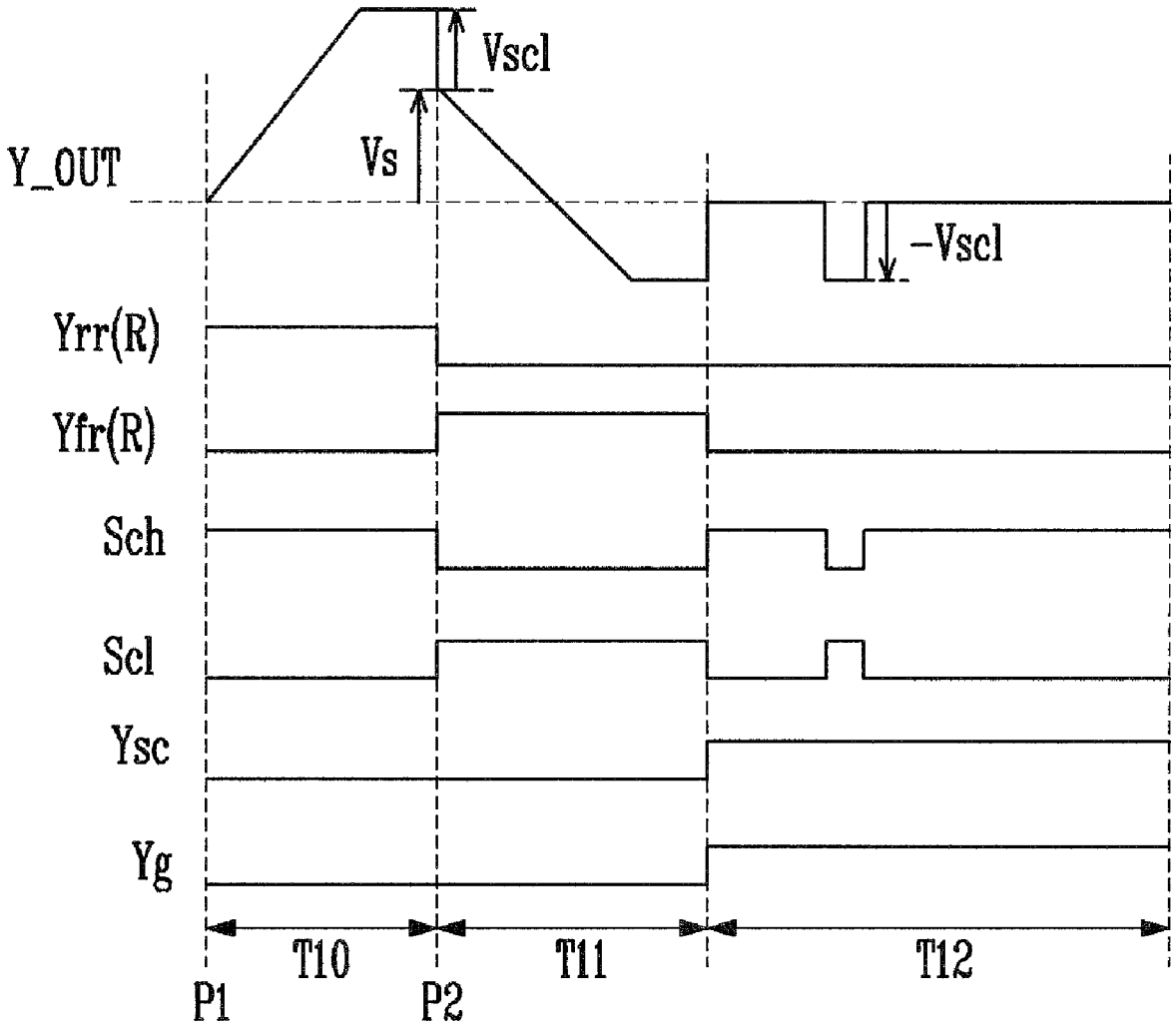
FIG. 12 illustrates driving waveforms supplied to the scan electrodes in a reset period and an address period and the operation processes of the switches.

FIG. 12 illustrates driving waveforms supplied to the scan electrodes in a reset period and an address period and the operation processes of the switches. FIGS. 13A to 13D illustrate current paths generated by the driving waveform of FIG. 12.

Figure 13A:
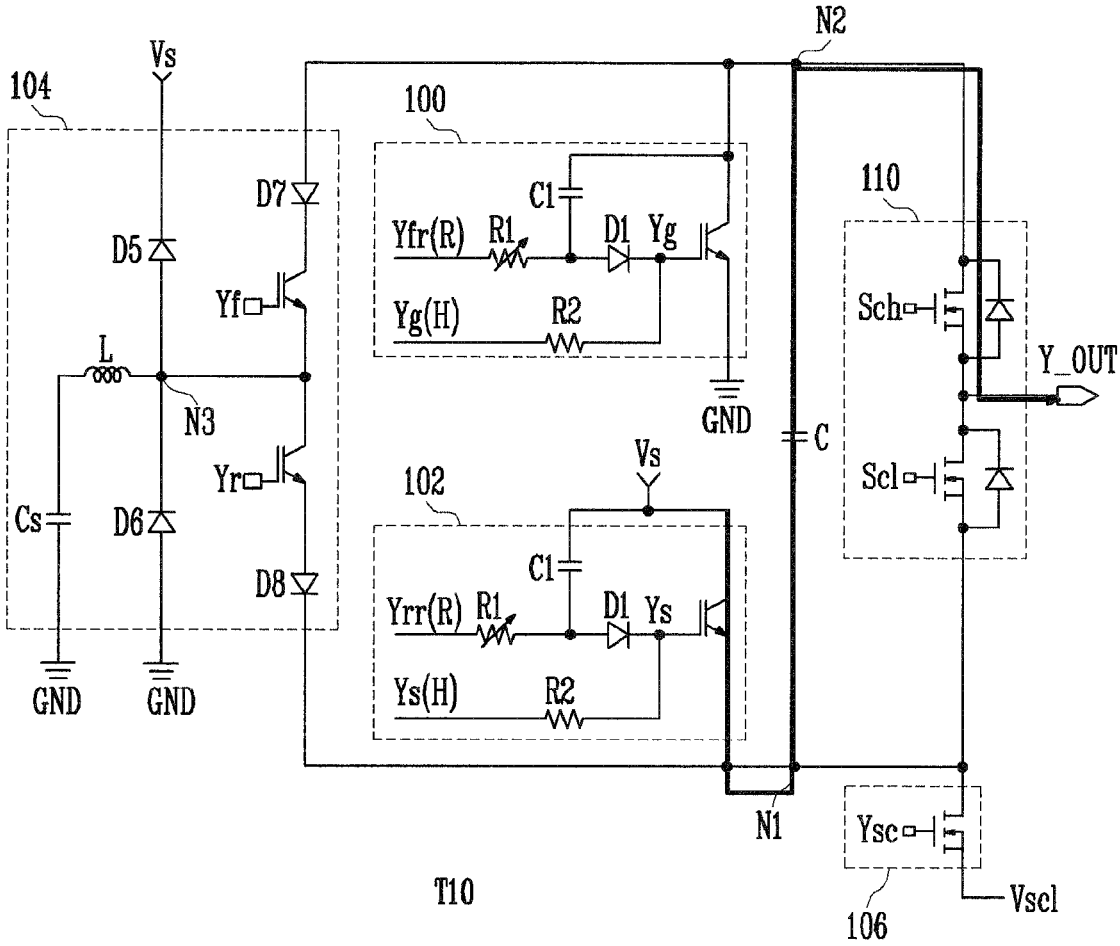
FIGS. 13A to 13D illustrate current paths generated by the driving waveform of FIG. 12.
Figure 13B:
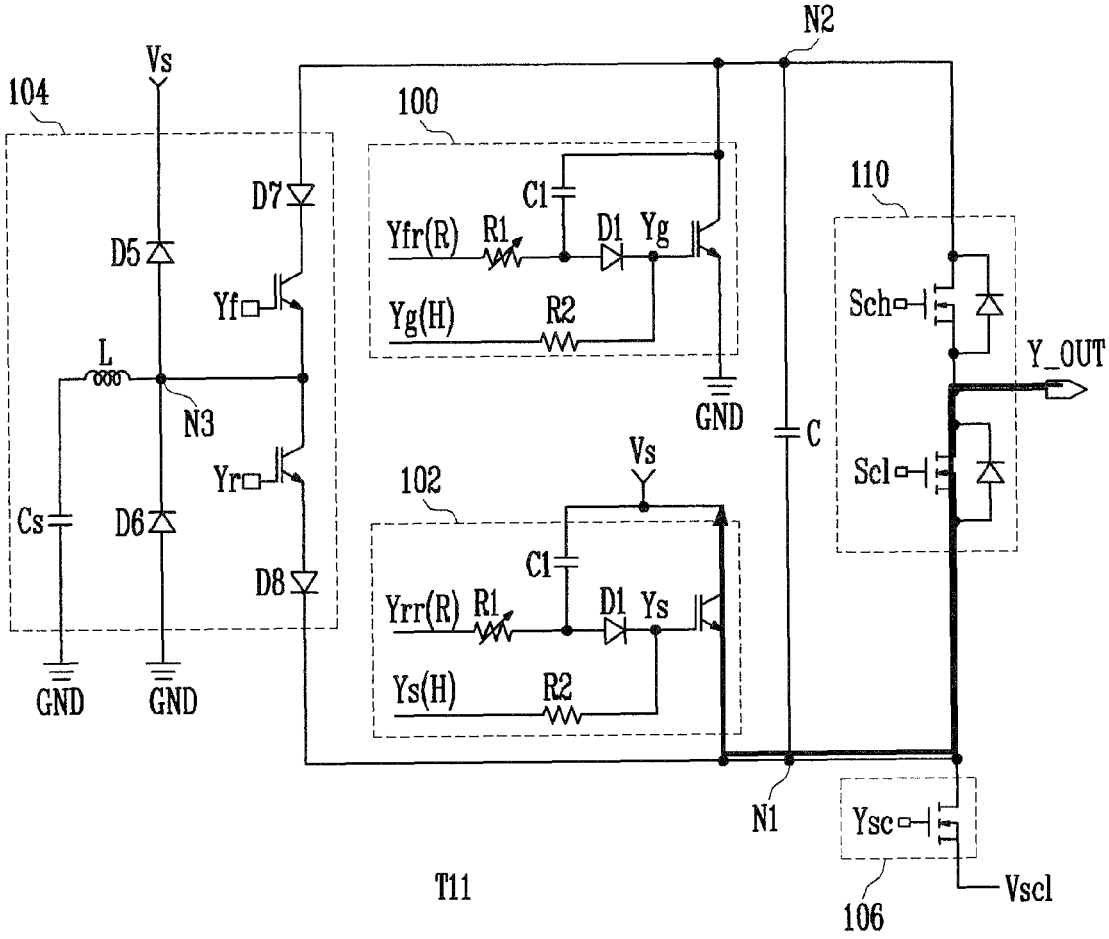
Figure 13C:
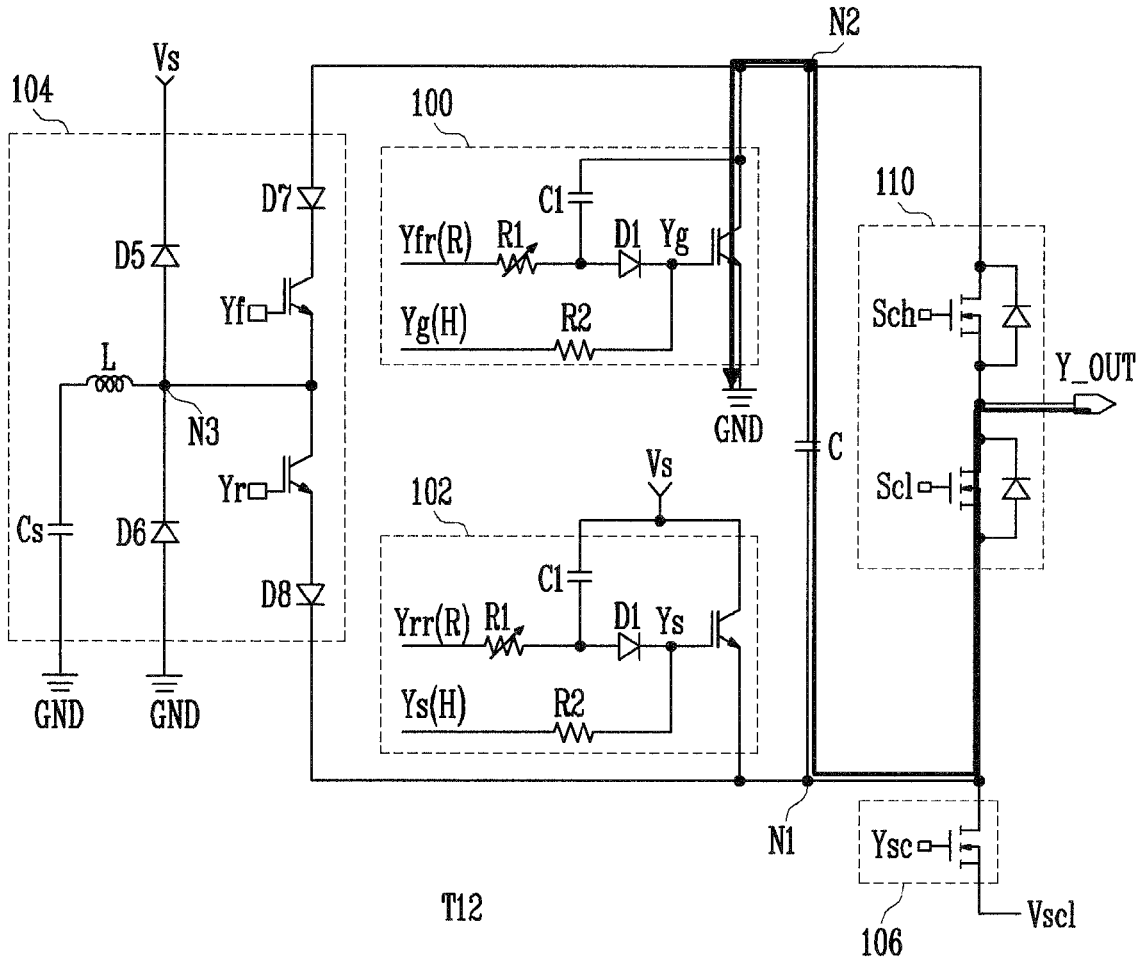
Figure 13D:
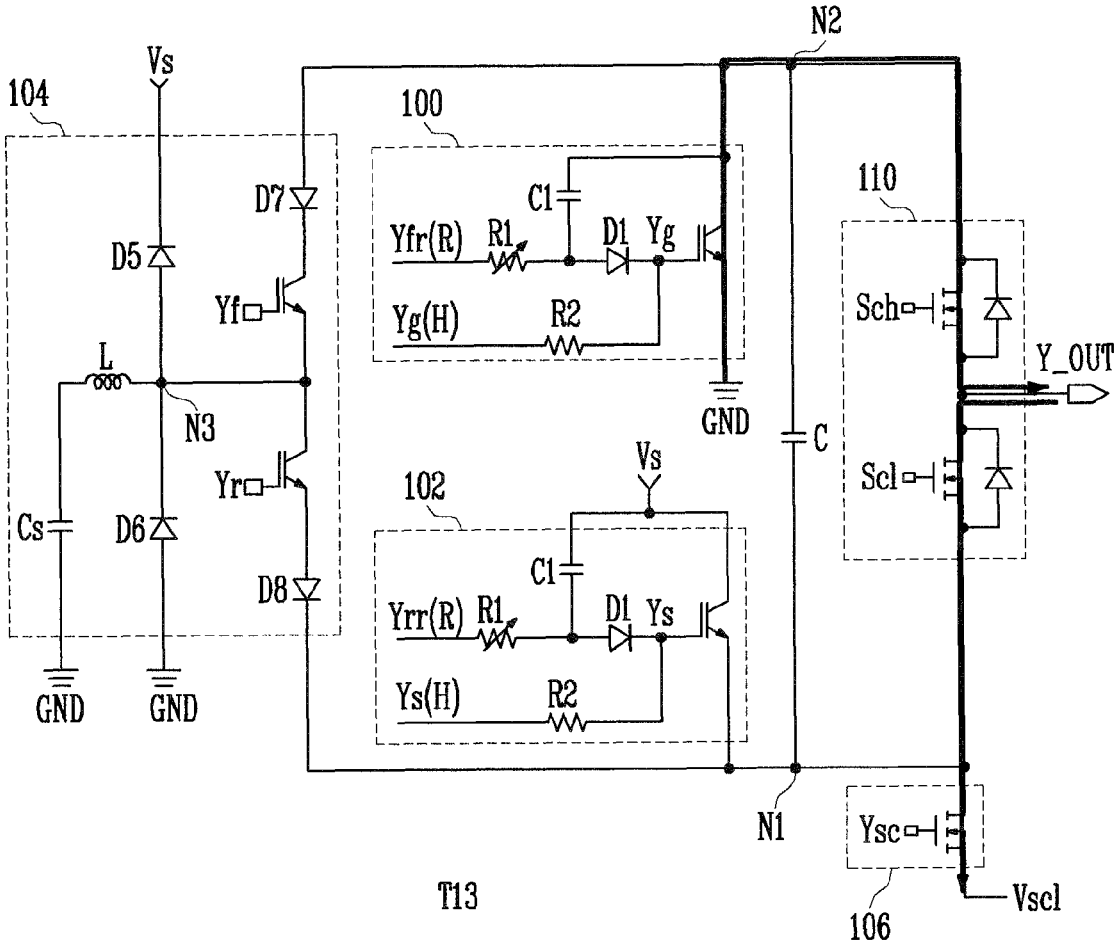

Operation processes will now be described with reference to FIGS. 12 to 13D. First, the transistor Ysc is turned on at a first point of time P1. When the transistor Ysc is turned on, the negative polar scan power source Vscl is supplied to the first node N1. At this time, the second node N2 receives the base power source GND from the transistor Yg.

Then, the transistor Ys and the transistor Sch are turned on in a $10^{th}$ period T10. The transistor Ys is turned on by the voltage supplied by the input terminal Yrr(R) via the first transistor Q1. When the transistor Ys and the transistor Sch are turned on, the current path illustrated in FIG. 13A is formed.

When the transistor Ys is turned on, the voltage of the sustain power source Vs is supplied to the first node N1. Then, the voltage of the first node N1 slowly increases from the negative polar scan power source Vscl to the sustain power source Vs. At this time, the voltage of the second node N2 slowly increases from the base power source GND to the sum of the voltage of the sustain power source Vs and the voltage of the scan power source Vscl (an absolute value voltage) by the capacitor C. Therefore, the rising ramp waveform is applied to the scan electrodes.

After the rising ramp waveform is applied to the scan electrodes, the transistor Scl is turned on at a second point of time P2. The transistor Scl is turned on to partially overlap the turning on point of time of the transistor Ys. Then, the current path illustrated in FIG. 13B is formed so that the transistor Scl is turned on. Therefore, the voltage of the scan electrode is reduced to the sustain power source Vs applied to the first node N1.

Then, in an $11^{th}$ period T11, a state in which the transistor Scl is turned on is maintained and the transistor Yg is turned on. The transistor Yg is turned on by the voltage applied by the input terminal Yfr(R) via the first resistor R1. When the transistor Yg and the transistor Scl are turned on, the current path illustrated in FIG. 13C is formed.

When the transistor Yg is turned on, the voltage of the second node N2 is slowly reduced from the sum of the voltage of the sustain power source Vs and the voltage of the scan power source Vscl (the absolute value voltage) to the voltage of the base power source GND. At this time, the voltage of the first node N1 is slowly reduced from the voltage of the sustain power source Vs to the voltage of the negative polar scan power source Vscl by the capacitor C. Therefore, a falling ramp waveform is applied to the scan electrodes.

After the falling ramp waveform is applied to the scan electrodes, in a $12^{th}$ period T12, the scan pulses are supplied to the scan electrodes. When the scan pulses are supplied, as illustrated in FIG. 13D, the transistor Scl and the transistor Ysc are turned on. Then, the voltage of the negative polar scan power source Vscl is supplied to the scan electrodes. Then, in a period where the scan pulses are not supplied, the transistor Sch and the transistor Yg are turned on. Then, the voltage of the base power source GND is supplied to the scan electrodes.

Figure 14:
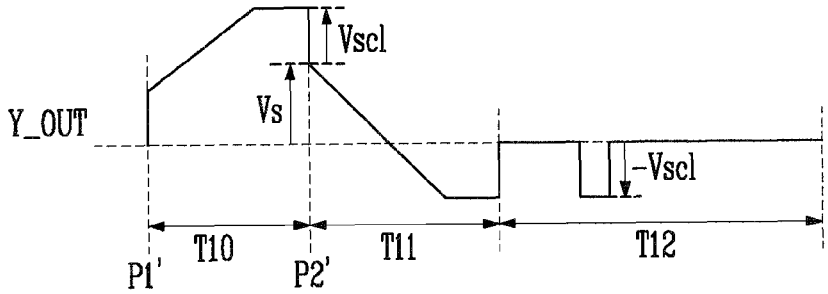
FIG. 14 illustrates another exemplary embodiment of the driving waveforms supplied to the scan electrodes in the reset period and the address period.

FIG. 14 illustrates another exemplary embodiment of the driving waveforms supplied to the scan electrodes in the reset period and the address period. In FIG. 14, a detailed description of the same parts as the parts of FIG. 12 will be omitted.

Referring to FIG. 14, first, the transistor Ysc is turned on before a first point of time P1'. When the transistor Ysc is turned on, the negative polar scan power source Vscl is supplied to the first node N1. At this time, the second node N2 receives the base power source GND from the transistor Yg.

Then, the transistor Yr is turned on at the first point of time P1'. When the transistor Yr is turned on, the voltage of the first node N1 increases to a voltage (e.g., a predetermined voltage). The increasing voltage of the first node N1 is determined by the turning on point of time of the transistor Yr. When the voltage of the first node N1 increases, the voltage of the second node N2 increases to correspond to the increasing voltage of the first node N1. Therefore, a voltage (e.g., a predetermined voltage) is applied to the scan electrodes.

Then, in the $10^{th}$ period T10, the transistor Ys and the transistor Sch are turned on. The transistor Ys is turned on by the voltage supplied by the input terminal Yrr(R) via the first resistor R1. When the transistor Ys is turned on, the voltage of the sustain power source Vs is supplied to the first node N1. Then, the voltage of the first node N1 slowly rises from a voltage (e.g., a predetermined voltage) to the sustain power source Vs. At this time, the voltage of the second node N2 slowly increases from the voltage (e.g., a predetermined voltage) to the sum of the voltage of the sustain power source Vs and the voltage of the scan power source Vscl (the absolute value voltage). Therefore, the voltage of a rising ramp waveform is applied to the scan electrodes.

Figure 15:
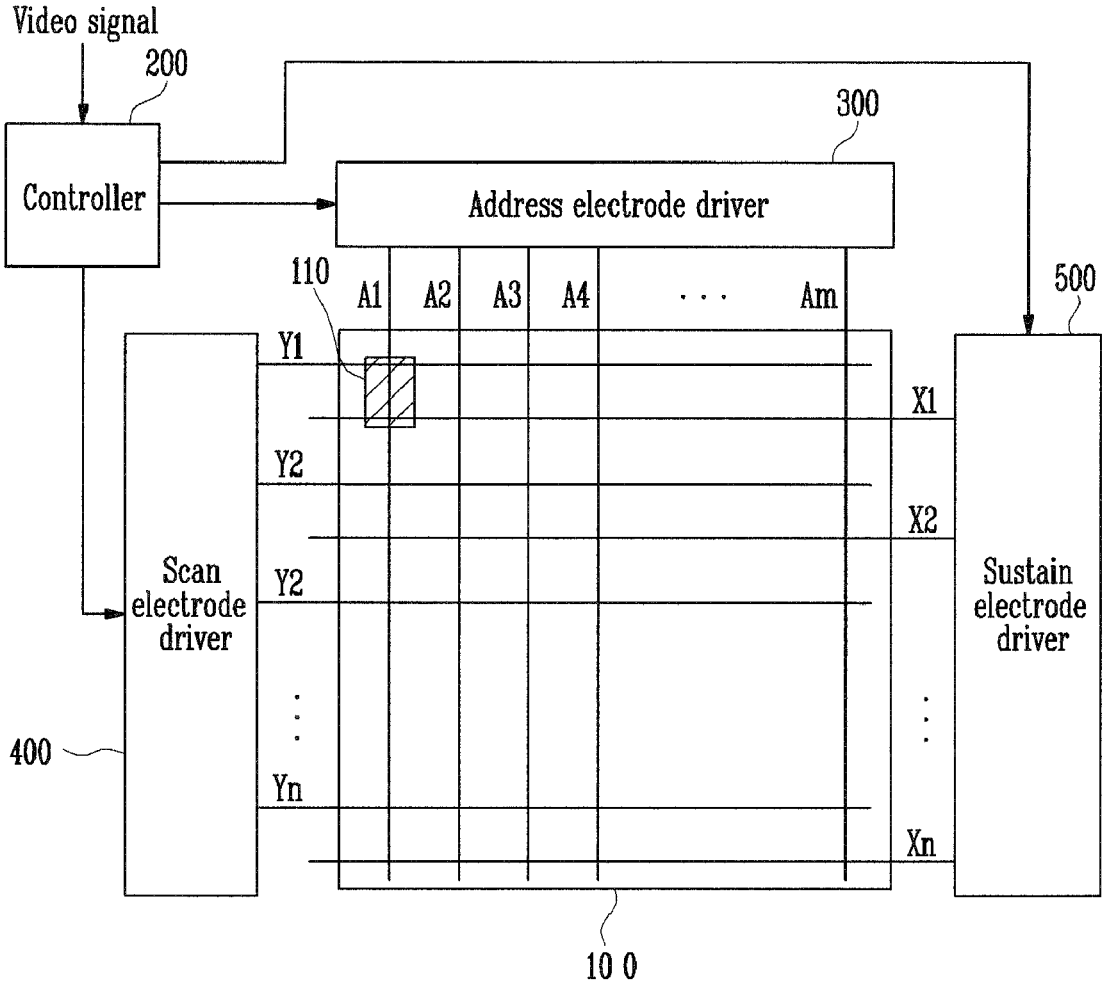
FIG. 15 is a schematic drawing illustrating a plasma display device according to an exemplary embodiment of the present invention.

FIG. 15 is a schematic drawing illustrating a plasma display device according to an exemplary embodiment of the present invention. As shown in FIG. 15, the plasma display device according to the exemplary embodiment of the present invention includes a plasma display panel (PDP) 100, a controller 200, an address electrode driver 300, a scan electrode driver 400, and a sustain electrode driver 500.

As described above, according to the present invention, the turning on and off of the transistors are controlled so that various driving waveforms can be supplied to the scan electrodes via the scan electrode driver 400.

According to the present invention, since the square wave and the ramp wave can be generated using one transistor, manufacturing costs can be reduced.

Although exemplary embodiments of the present invention have been shown and described, it would be appreciated by those skilled in the art that changes might be made in these embodiments without departing from the principles and spirit of the invention, the scope of which is defined in the claims and their equivalents.

What is claimed is:

1. A plasma display device, comprising:

discharge cells at crossing regions of scan electrodes, sustain electrodes, and address electrodes; and a scan driver comprising:

a selection circuit for selectively supplying voltages between a first node and a second node to the scan electrodes;

a capacitor coupled between the first node and the second node;

a first waveform generator coupled to a base power source for supplying a base power source voltage, the first waveform generator being configured to alternatively supply to the second node a rapidly falling waveform that falls rapidly to the base power source voltage and a falling ramp waveform that falls with a slope to the base power source voltage;

a second waveform generator coupled to a sustain power source for supplying a sustain power source voltage, the second waveform generator being configured to supply to the first node a rapidly increasing waveform that increases rapidly to the sustain power source voltage and a rising ramp waveform that rises with a slope to the sustain power source voltage;

an energy recovery circuit for supplying sustain pulses to the scan electrodes; and a scan pulse supplier coupled between the first node and a scan power source, wherein each of the first waveform generator and the second waveform generator comprises:

a first transistor having a drain electrode, a gate electrode, and a source electrode;

a first resistor and a first diode coupled at a common node between a first input terminal and the gate electrode;

a second resistor coupled between the gate electrode and a second input terminal; and a first capacitor coupled between the drain electrode and the common node between the first resistor and the first diode.

2. The plasma display device as claimed in claim 1, wherein the first resistor is a variable resistor.

3. The plasma display device as claimed in claim 1, wherein the drain electrode of the first transistor of the first waveform generator is coupled with the second node and the source electrode of the first transistor of the first waveform generator is coupled with the base power source.

4. The plasma display device as claimed in claim 1, wherein the drain electrode of the first transistor of the second waveform generator is coupled with the sustain power source and the source electrode of the first transistor of the second waveform generator is coupled with the first node.

5. The plasma display device as claimed in claim 1, wherein the first diode is coupled to allow a current to flow from the first resistor to the gate electrode.

6. The plasma display device as claimed in claim 1, further comprising a third diode coupled between the gate electrode and the first input terminal to allow a current to flow from the gate electrode to the first input terminal.

7. The plasma display device as claimed in claim 1, further comprising a second diode coupled between the second resistor and the gate electrode to allow a current to flow from the second resistor to the gate electrode.

8. The plasma display device as claimed in claim 1, further comprising a voltage stabilizer coupled between the first capacitor and the drain electrode.

9. The plasma display device as claimed in claim 8, wherein the voltage stabilizer comprises:

a fourth diode coupled to allow a current to flow from the first capacitor to the drain electrode; and a third resistor coupled with the fourth diode in parallel.

10. The plasma display device as claimed in claim 1, wherein the energy recovery circuit comprises:

a source capacitor for charging a voltage recovered from the scan electrodes;

an inductor coupled between the source capacitor and the scan electrodes;

a second transistor coupled between the inductor and the second node and configured to turn on when a voltage is supplied from the scan electrodes to the source capacitor; and a third transistor coupled between the inductor and the first node and configured to turn on when a voltage is supplied from the source capacitor to the scan electrodes.

11. The plasma display device as claimed in claim 10, wherein the first waveform generator supplies the base power source voltage to the scan electrodes after the second transistor is turned on, and wherein the second waveform generator supplies the sustain power source voltage to the scan electrodes after the third transistor is turned on.

12. The plasma display device as claimed in claim 1, further comprising an integrated circuit positioned between the first input terminal and the first resistor and between the second input terminal and the second resistor, wherein the integrated circuit comprises:

a first integrated circuit transistor and a second integrated circuit transistor coupled between a first power source and the base power source in an $i^{th}$ channel, where i is a natural number, a common terminal of the first integrated circuit transistor and the second integrated circuit transistor being coupled to the first resistor;

a third integrated circuit transistor and a fourth integrated circuit transistor coupled between the first power source and the base power source in an $(i+1)^{th}$ channel, a common terminal of the third integrated circuit transistor and the fourth integrated circuit transistor being coupled to the second resistor;

an OR gate for performing an OR operation on voltages supplied from the first input terminal and the second input terminal to supply an OR operation result to gate electrodes of the first integrated circuit transistor and the second integrated circuit transistor;

a first inverter for inverting the OR operation result and for supplying the inverted OR operation result to the second integrated circuit transistor; and a second inverter for inverting a voltage supplied by the second input terminal and for supplying the inverted voltage to the fourth integrated circuit transistor.

13. The plasma display device as claimed in claim 1, further comprising an integrated circuit coupled between the first input terminal and the first resistor and between the second input terminal and the second resistor, wherein the integrated circuit comprises:

a first integrated circuit transistor and a second integrated circuit transistor coupled between a first power source and the base power source in an $i^{th}$ channel, a common terminal of the first integrated circuit transistor and the second integrated circuit transistor being coupled to the first resistor;

a third integrated circuit transistor and a first integrated circuit resistor coupled between the first power source and the base power source in an $(i+1)^{th}$ channel, a common terminal of the third integrated circuit transistor and the first integrated circuit resistor being coupled to the second resistor; and a NOR gate for performing a NOR operation on voltages supplied from the first input terminal and the second input terminal to supply a NOR operation result to a gate electrode of the second integrated circuit transistor.

14. The plasma display device as claimed in claim 1, further comprising an integrated circuit coupled between the first input terminal and the first resistor and between the second input terminal and the second resistor, wherein the integrated circuit comprises:

a first integrated circuit transistor and a first integrated circuit resistor coupled between a first power source and the base power source in an $i^{th}$ channel, a common terminal of the first integrated circuit transistor and the first integrated circuit resistor being coupled to the first resistor; and a second integrated circuit transistor and a second integrated circuit resistor coupled between the first power source and the base power source in an $(i+1)^{th}$ channel, a common terminal between the second integrated circuit transistor and the second integrated circuit resistor being coupled with the second resistor.

15. The plasma display device as claimed in claim 14, wherein the integrated circuit further comprises:

a third integrated circuit transistor coupled between the gate electrode of the first transistor and the base power source; and a NOR gate coupled to a gate of the third integrated circuit transistor, the first input terminal and the second input terminal being inputs to the NOR gate.

16. The plasma display device as claimed in claim 15, wherein the first input terminal is coupled to a gate of the first integrated circuit transistor and the second input terminal is coupled to a gate of the second integrated circuit transistor.

* * * * *